US008305165B2

(12) United States Patent
Widgery

(10) Patent No.: US 8,305,165 B2
(45) Date of Patent: Nov. 6, 2012

(54) DIELECTRIC RESONANT OSCILLATOR HAVING PRINTED CIRCUIT PROBES THAT CONFORM TO THE CURVATURE OF A CASING WALL

(75) Inventor: Martin P Widgery, Ryde (GB)

(73) Assignee: BAE SYSTEMS plc, London (GB)

( * ) Notice: Subject to any disclaimer, the term of this patent is extended or adjusted under 35 U.S.C. 154(b) by 159 days.

(21) Appl. No.: 12/301,295

(22) PCT Filed: Aug. 5, 2008

(86) PCT No.: PCT/GB2008/050664

§ 371 (c)(1),
(2), (4) Date: Mar. 11, 2009

(87) PCT Pub. No.: WO2009/027719

PCT Pub. Date: Mar. 5, 2009

(65) Prior Publication Data

US 2010/0171573 A1 Jul. 8, 2010

(30) Foreign Application Priority Data

Aug. 31, 2007 (EP) ..... 07253450
Aug. 31, 2007 (GB) ..... 0716964.2

(51) Int. Cl.
*H01P 7/10* (2006.01)

(52) U.S. Cl. ..... 333/219.1; 333/235

(58) Field of Classification Search ..... 333/202, 333/219.1, 235

See application file for complete search history.

(56) References Cited

U.S. PATENT DOCUMENTS

| | | | | |
|---|---|---|---|---|
| 3,443,131 | A | 5/1969 | Oltman | |
| 4,477,785 | A * | 10/1984 | Atia | 333/202 |
| 4,646,038 | A | 2/1987 | Wanat | |
| 4,686,496 | A * | 8/1987 | Syrett et al. | 333/202 |
| 4,922,211 | A * | 5/1990 | Otremba et al. | 331/68 |
| 5,233,319 | A | 8/1993 | Mizan | |
| 5,324,713 | A * | 6/1994 | Shen | 505/210 |
| 6,175,286 | B1 * | 1/2001 | Ueno | 333/219.1 |
| 6,954,124 | B2 * | 10/2005 | Enokihara et al. | 333/219.1 |

FOREIGN PATENT DOCUMENTS

| | | |
|---|---|---|
| JP | 59-134902 | 2/1984 |
| JP | 2001060810 | 6/2001 |
| JP | 2001160702 | 6/2001 |

OTHER PUBLICATIONS

Notification of Transmittal of International Search Report, International Search Report and Written Opinion of the International Searching Authority issued in related application PCT/GB2008/050664, Oct. 20, 2008, 15 pages.
International Preliminary Report on Patentability issued in related application PCT/GB2008/050664, Mar. 2, 2010, 8 pages.

(Continued)

*Primary Examiner* — Benny Lee
(74) *Attorney, Agent, or Firm* — Pillsbury Winthrop Shaw Pittman LLP

(57) ABSTRACT

The present invention relates to low vibration probes. Specifically, the present invention relates to low vibration probes in dielectric resonant oscillators. Accordingly, the present invention provides a dielectric resonant oscillator apparatus comprising a casing; a lid; a puck mounted on a support and one or more probes wherein the support comprises a hollow ceramic tube.

12 Claims, 3 Drawing Sheets

OTHER PUBLICATIONS

Notification of International Search Report, International Search Report and Written Opinion of the International Searching Authority issued in PCT/B2008/050664, Oct. 20, 2008, 15 pages.

European Search Report issued in EP 07253450.6, Jan. 30, 2008, 7 pages.

GB Search Report issued in GB0716964.2, Nov. 1, 2007, 3 pages.

* cited by examiner

DIELECTRIC RESONANT OSCILLATOR HAVING PRINTED CIRCUIT PROBES THAT CONFORM TO THE CURVATURE OF A CASING WALL

CROSS REFERENCE TO RELATED APPLICATIONS

This is the U.S. National Phase of PCT/GB2008/050664, filed Aug. 5, 2008, which claims priority to British Application No. 0716964.2, filed Aug. 31, 2007, and European Application No. 07253450.6, filed Aug. 31, 2007, the entire contents of all of which are incorporated herein by reference.

FIELD

The present invention relates to low vibration dielectric resonant oscillators. Specifically, the present invention relates to low vibration probes for dielectric resonant oscillators.

Known dielectric resonant oscillator devices operate well in the 10 GHz range, however they are not used in the S-band (~3 GHz~) range as the standard design does not work well due to the susceptibility of the known apparatus to vibrations.

As illustrated in FIG. 1, such a known device 1 would typically comprise a case 70 with a screw-on lid 10. The case 70 and lid 10 define the resonant cavity 30 inside, which has mounted therein a puck (dielectric resonator) 40 on a thin support rod 50 and two probes 20. The thin support rod extends through the bottom of the case 70 and is fastened to the bottom of the outside of the case 70 by a fastener 60, which is typically a bolt. The probes 20 also extend outside the case 70, through the sides of the case, so that they can be wired up to suitable apparatus (not shown) to fulfill their function.

SUMMARY

In one embodiment, the present invention provides a dielectric resonant oscillator apparatus comprising a casing; a lid; a puck mounted on a support and one or more probes wherein the probes are formed as printed circuit boards that conform to the shape of the casing.

An advantage of the present invention is that the apparatus is improved sufficiently to be used in the 1 to 4 GHz range by modifying the lid, the puck and the probes.

BRIEF DESCRIPTION OF DRAWINGS

Specific embodiments of the invention will now be described, by way of example only and with reference to the accompanying drawings that have like reference numerals, wherein.

DETAILED DESCRIPTION OF DRAWINGS

Figure 2:
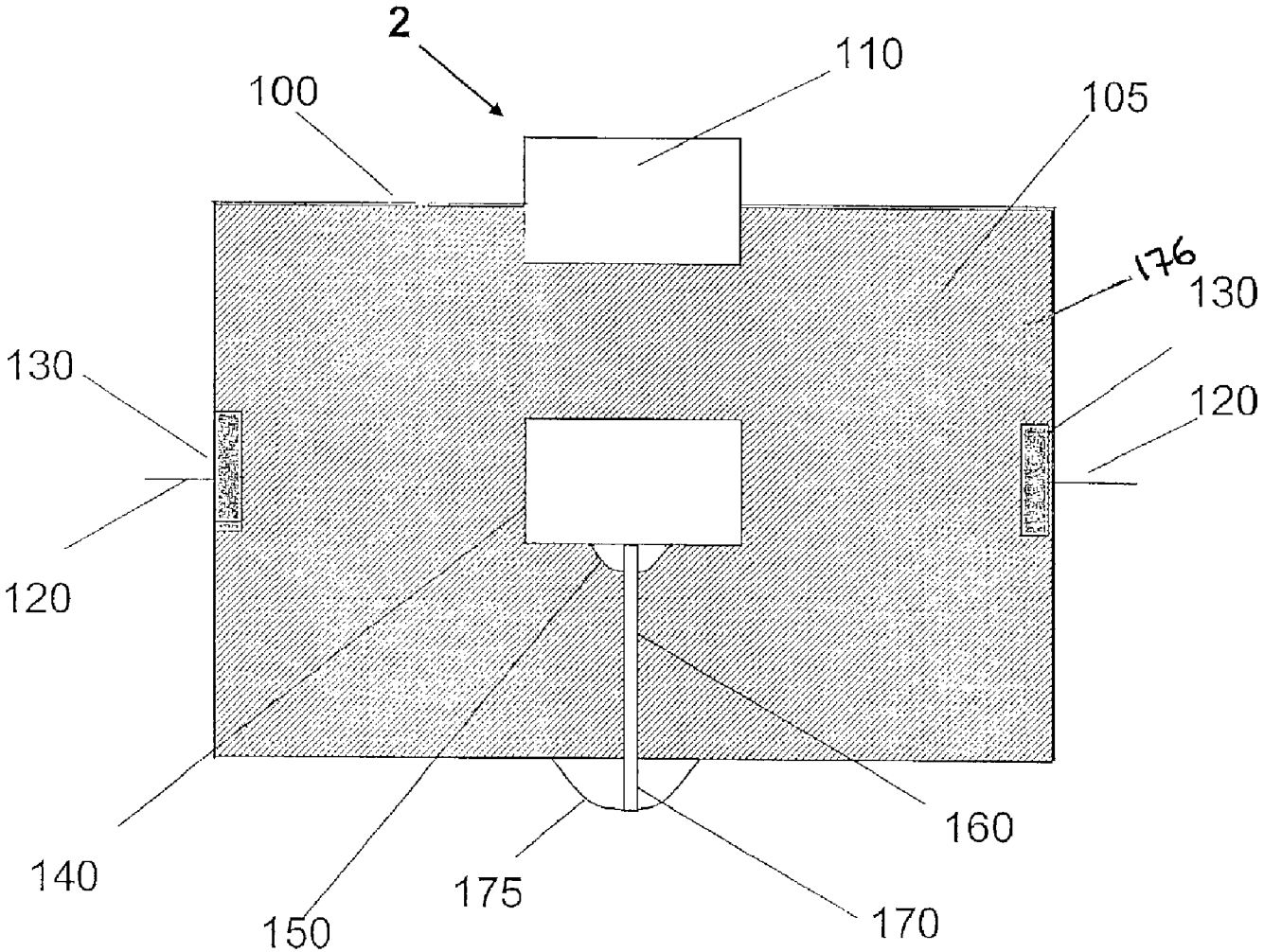
FIG. 2 is a cross-sectional drawing of a dielectric oscillator device according to an embodiment of the present invention.
Figure 3:
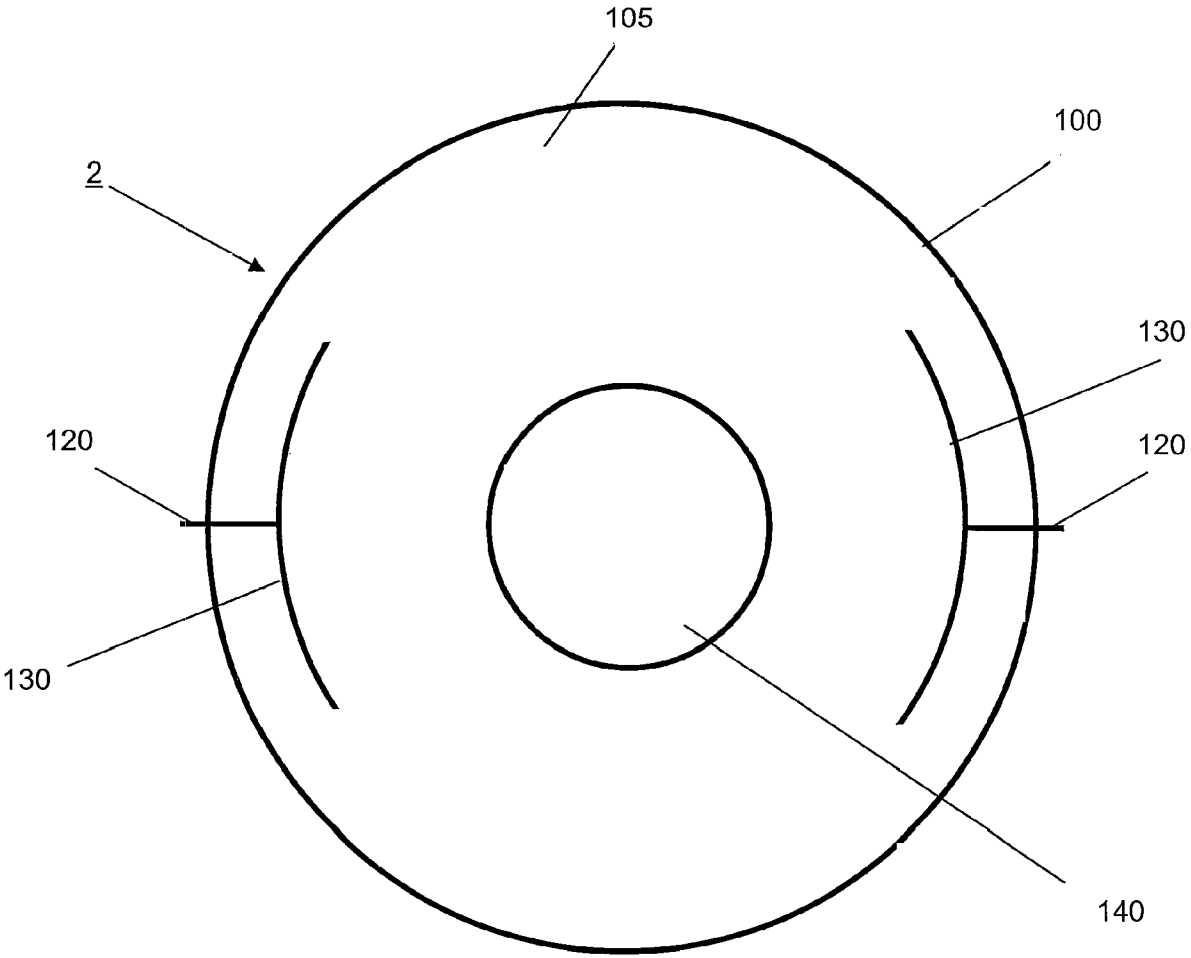
FIG. 3 is a top view drawing schematically showing the cylindrical inside wall of the casing of the dielectric oscillator device according to an embodiment of the present invention.

A specific embodiment of the present invention will now be described with reference to FIGS. 2 and 3:

A dielectric resonant oscillator 2 according to a specific embodiment of the present invention is shown in FIGS. 2 and 3. The dielectric resonant oscillator 2 comprises a case 100 with a lockable tuning screw 110 defining a resonant cavity 105 inside. Mounted in the resonant cavity 105 (as shown in FIG. 3) is a puck (dielectric oscillator) 140 (as shown in FIG. 3) on a hollow ceramic tubular support 160. The hollow ceramic tubular support 160 is mounted in a recess 175 in the bottom of the case 100 and fixed in place by ceramic paste 170 that fills the recess 175. The hollow ceramic tubular support 160 is also fixed to the bottom of the puck 140 using ceramic paste 150. As shown in FIGS. 2 and 3, the two probes 130 are formed on printed circuit boards which conform to the curvature of the inside of the wall of the case 100 and which have wires 120 extending though the wall of the case 100 to the apparatus (not shown) connected to the probes 130.

Use of a hollow tubular ceramic resonator support 160 allows for a wider support base and provides increased rigidity. The support 160 is mounted in a specially designed recess 175 at the base of the cavity 105, which is filled with ceramic paste 170 to glue the support 160 in place, which also contributes to increased rigidity and increases the "gluing area".

Figure 1:
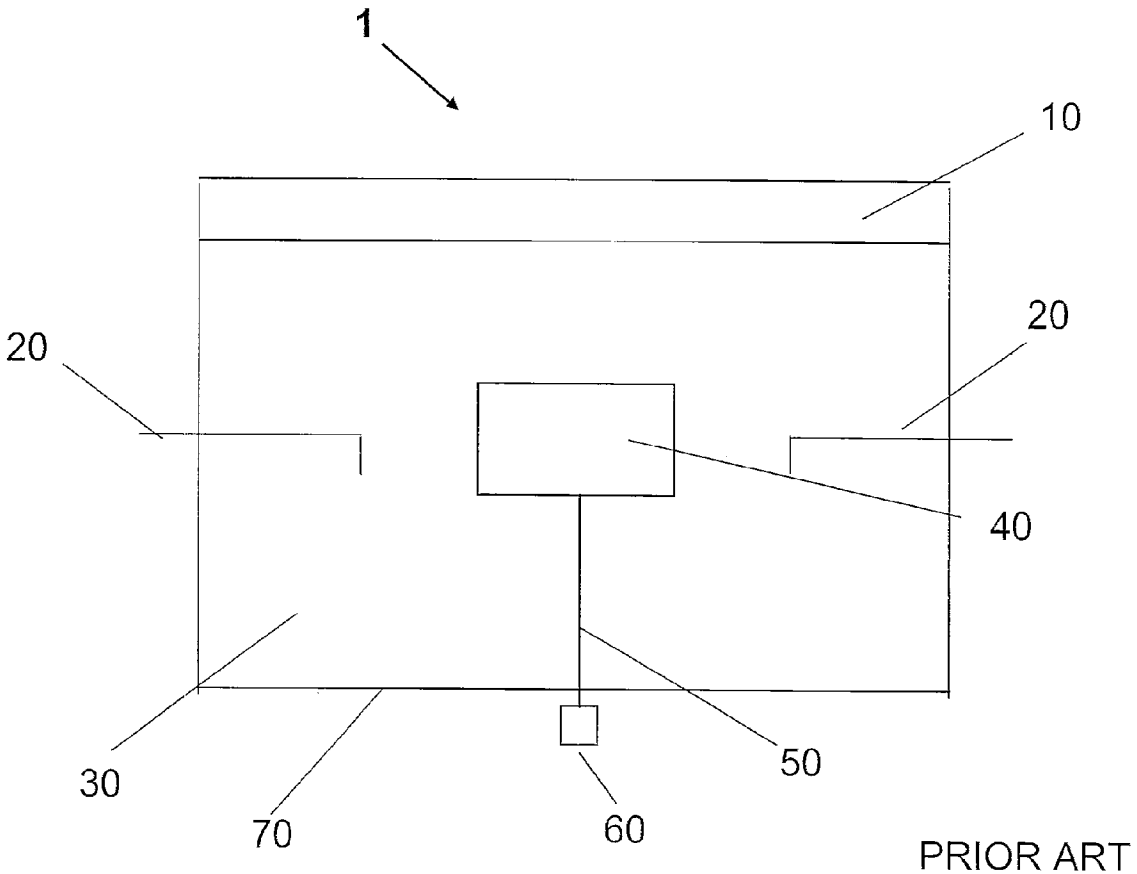
FIG. 1 is a cross-sectional drawing of a known dielectric oscillator device.

Use of printed circuit boards conforming to the shape of the inside of the cylindrical resonant cavity 105 overcomes the vibration risk of the known electrical probes in FIG. 1, which were provided just as wires extending through holes in the cylinder and into the resonant cavity. The PCBs are glued to the sides of the resonant cavity to prevent movement.

The lockable tuning screw 110 allows for very fine adjustment of the volume of the cavity.

Alternatively, the cavity 105 can be filled with dielectric foam 176 instead of being hollow. This would also mean that the probes 130 need not be glued in place, as they would be held in place by the dielectric foam 176.

Further, as another alternative, the cylinder that forms the case 100 can be made from a single piece of metal as this would improve heat distribution and further decrease vibrations.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A dielectric resonant oscillator apparatus comprising:

a casing;

a lockable tuning screw, the casing and the screw defining a cylindrical resonant cavity;

a dielectric oscillator puck mounted in the resonant cavity on a hollow ceramic tubular support; and one or more probes, wherein the probes are formed on printed circuit boards that conform to a curvature of a curved inside of a wall of the casing.

2. An apparatus according to claim 1, wherein the support is fixed to the puck using ceramic paste.

3. An apparatus according to claim 2, wherein the casing is filled with dielectric foam.

4. An apparatus according to claim 2, wherein the casing is formed from a single piece of metal.

5. An apparatus according to claim 1, wherein the casing is formed from a single piece of metal.

6. An apparatus according to claim 1, wherein the support is fixed to the casing using ceramic paste.

7. An apparatus according to claim 6, wherein the casing is formed from a single piece of metal.

8. An apparatus according to claim 6, wherein the casing is filled with dielectric foam.

9. An apparatus according to claim 1, wherein the casing is filled with dielectric foam.

10. An apparatus according to claim 9, wherein the casing is formed from a single piece of metal.

11. A dielectric resonant oscillator apparatus comprising:

a casing;

a lockable tuning screw, the casing and the screw defining a cylindrical resonant cavity;

a puck mounted in the resonant cavity on a support; and one or more probes, wherein the probes are formed on printed circuit boards that conform to a curvature of an inside of a wall of the casing, wherein the support is fixed to the puck using ceramic paste and wherein the support is mounted in a recess in the resonant cavity, the recess is filled with ceramic paste to fix the support in place.

12. A dielectric resonant oscillator apparatus comprising:

a casing;

a lockable tuning screw, the casing and the screw defining a cylindrical resonant cavity;

a puck mounted in the resonant cavity on a support; and one or more probes, wherein the probes are formed on printed circuit boards that conform to a curvature of an inside of a wall of the casing, and wherein the inside of the wall of the casing provides curved sides of the resonant cavity and the printed circuit boards are glued to the curved sides to prevent movement.

* * * * *